US006964572B2

(12) United States Patent
Cesa

(10) Patent No.: US 6,964,572 B2
(45) Date of Patent: Nov. 15, 2005

(54) INTERACTIVE TOY

(75) Inventor: Joseph A. Cesa, Warwick, RI (US)

(73) Assignee: The First Years Inc., Avon, MA (US)

( * ) Notice: Subject to any disclaimer, the term of this patent is extended or adjusted under 35 U.S.C. 154(b) by 14 days.

(21) Appl. No.: 10/427,333

(22) Filed: May 1, 2003

(65) Prior Publication Data

US 2004/0219499 A1 Nov. 4, 2004

(51) Int. Cl.[7] ..... A63H 1/28

(52) U.S. Cl. ..... 434/258; 446/3; 446/236; 446/269; 446/280; 446/431; 446/437; 446/442; 446/443; 446/457

(58) Field of Search ..... 434/258; 446/236–237, 446/431, 437, 442–443, 274, 3, 269, 280, 457

(56) References Cited

U.S. PATENT DOCUMENTS

| | | | | |
|---|---|---|---|---|
| 2,939,246 A | | 6/1960 | Glos, II | |
| 3,798,835 A | | 3/1974 | McKeehan | |
| 4,391,224 A | | 7/1983 | Adler | |
| 5,533,920 A | | 7/1996 | Arad et al. | |
| D375,986 S | | 11/1996 | Wilkinson et al. | |
| 5,692,946 A | | 12/1997 | Ku | |
| 5,720,644 A | | 2/1998 | Ku | |
| 5,893,791 A | | 4/1999 | Wilkinson | |
| 6,027,395 A | * | 2/2000 | Strom | 446/274 |
| 6,039,628 A | * | 3/2000 | Kusmiss et al. | 446/457 |
| 6,227,933 B1 | | 5/2001 | Michaud et al. | |
| 6,250,987 B1 | * | 6/2001 | Choi | 446/436 |
| 6,354,842 B1 | * | 3/2002 | Frei | 434/365 |
| 6,378,634 B1 | | 4/2002 | Yim | |
| 6,485,349 B1 | | 11/2002 | Snyder et al. | |
| 6,514,117 B1 | | 2/2003 | Hampton et al. | |

FOREIGN PATENT DOCUMENTS

| | | | | |
|---|---|---|---|---|
| GB | 2216025 A | * | 10/1989 | A63H/17/40 |
| WO | WO 97/01381 | | 1/1997 | |
| WO | WO 2004/006204 A1 | * | 7/2004 | G08B/25/00 |

* cited by examiner

*Primary Examiner*—Chanda L. Harris
(74) *Attorney, Agent, or Firm*—Fish & Richardson P.C.

(57) ABSTRACT

A developmental toy for small children includes a contacting member is rotated by an electric motor and a controller that, in response to input from a sensor, signals the electric motor to move the toy from a starting position for an initial period of time in an initial direction and signals the motor to wait a resting period of time. If no further input is received from a child that is detected by the sensor within the resting period of time, the controller signals the motor to move the toy back in an opposite sense, toward the starting location.

24 Claims, 5 Drawing Sheets

INTERACTIVE TOY

TECHNICAL FIELD

This invention relates to toys, and more particularly to developmental toys for small children.

BACKGROUND

It is a common object to promote the ability of a small child or infant to crawl. This can be a difficult task without repeated encouragement, due, at least in part, to the relatively short attention span of small children. Motorized toy balls that move continuously until they are shut down or exhaust their power source have been suggested for this purpose.

SUMMARY

A developmental toy is provided that promotes the ability of a small child or infant to crawl. The developmental toy, in response to indication, moves from a starting position for an initial period of time in an initial direction, and then waits a waiting period of time. If no further input is received within the waiting period of time, the toy moves in an opposite sense, generally toward the starting location.

In an aspect, the invention features a developmental toy for small children. The toy includes a contacting member and a motor that rotates the contacting member to move the toy along a surface. A sensor is provided that is responsive to input from a child. A controller, in response to indication from the sensor of receipt of input, signals the motor to move the toy from a starting position for an initial period of time in an initial direction, signals the motor to wait a waiting period of time, and if no further input is received within the period of time, signals the motor to move the toy in an opposite sense, generally toward the starting location.

In yet another aspect, the invention features a developmental toy for small children that includes a contacting member configured to move the toy. A bi-directional motor including a drive shaft is included that is operatively connected to the contacting member. The bi-directional motor is adapted to rotate the drive shaft in a first direction and in a second, opposite direction. A control means for actuating the bi-directional motor to rotate the contacting member and move the toy along a surface a distance and for pausing the bi-directional motor to maintain a position of the toy is provided. In response to an induced motion, the control means actuates the bi-directional motor in the first direction for an initial period of time and pauses the bi-directional motor after the first period of time for a resting period of time. In the absence of a second induced motion during the resting period of time, the control means actuates the bi-directional motor in the second direction for a second period of time.

Implementations of this aspect may include one or more of the following features. For example, the second period of time may be about equivalent to the initial period of time. The second period of time may be different from the initial period of time.

A sensor means can also be included for sensing induced motion of the toy and for providing a signal to the control means in response to induced motion.

In another aspect, the invention features a method for developing the motor skills of a child using a developmental toy having a contacting member, an electric motor that rotates the contacting member to move the toy along a surface, a sensor responsive to input from a child and a controller that, in response to indication from the sensor of receipt of the input, signals the electric motor to move the toy. The method includes, in response to indication from the sensor, moving the toy from an initial position for an initial period of time; pausing the toy for a resting period of time; and if no signal received from the sensor within the resting period of time, moving the toy in an opposite sense, generally toward the starting location.

In yet another aspect, the invention features a method for developing motor skills of a small child using a toy. The method includes providing control circuitry for controlling actuation of a motor, the motor configured to rotate a drive shaft in a first direction and in an opposite, second direction; operatively connecting the drive shaft to a contacting member to cause rotation of the contacting member, the contacting member configured to move the toy a distance; signaling the control circuitry to actuate the motor to rotate the drive shaft in the first direction for moving the toy in an initial direction for an initial period of time along a surface in response to a first induced motion of the toy; signaling the control circuitry to discontinue actuation of the motor for a waiting period of time; and in the absence of a second induced motion for the waiting period of time, signaling the control circuitry to actuate the motor in the second direction for moving the toy in a sense generally opposite the initial direction.

Implementations of any of the above aspects may contain one or more of the following features. The controller may signal the motor to move the toy for a second period of time less than 100 percent of the initial period of time in the opposite sense such as from about one-quarter to about three quarters of the initial period of time. The controller may signal the motor to move the toy for a second period of time about one-third of the initial time in the opposite sense. The controller may also signal the motor to move the toy for a second period of time for about the initial period of time in the opposite sense.

The contacting member may define an arcuate contacting surface configured to roll along a surface. The toy may include a body and the contacting member may be a wheel that rotates with respect to the body. The toy may be in the form of a ball with the contacting member defining an exterior surface of the ball. Where the toy is in the form of a ball, the toy can further include an eccentric weight with the motor rotating the contacting member with respect to the eccentric weight.

The input may be an induced motion of the toy. In these cases, the induced motion may be a linear and/or a rotational acceleration of the toy.

The toy may further include a sound source for providing audible sound. The sound source may provide audible sound while the ball moves and/or waits or pauses.

In some cases, the toy moves in the opposite sense at an angle between about 90 degrees to about 270 degrees relative to the initial direction of the toy, such as about 180 degrees.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
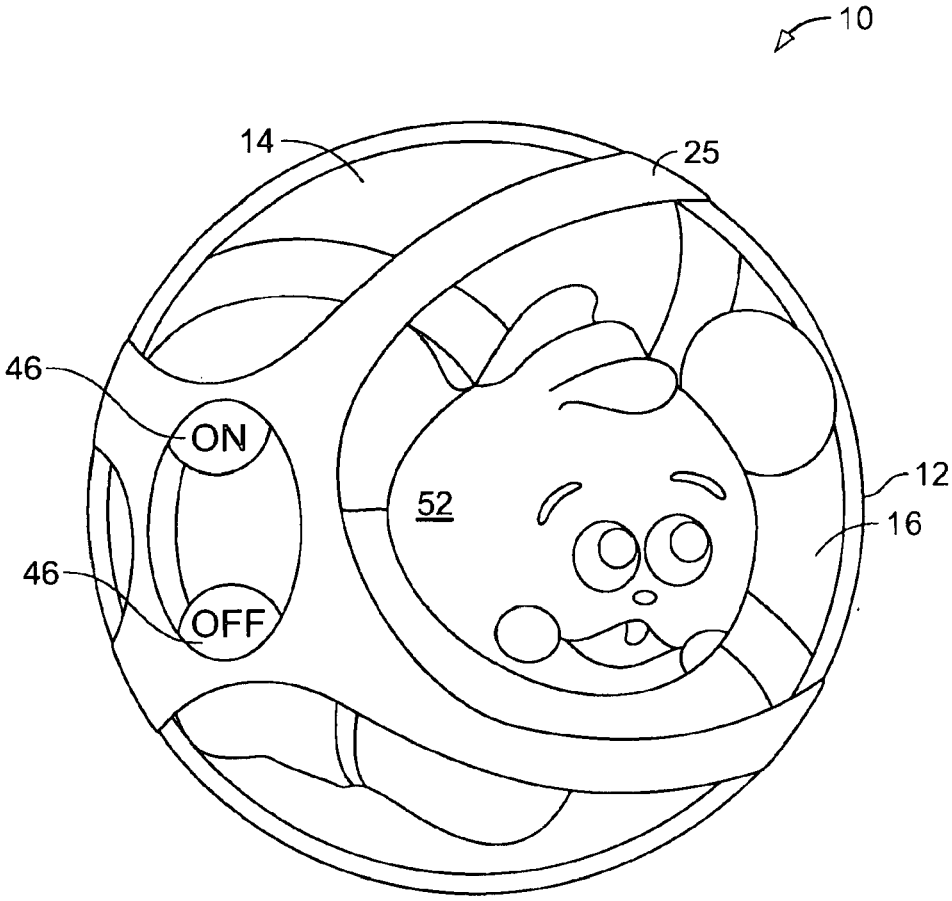
FIG. 1 is a perspective view of a toy.

FIG. 1 illustrates an embodiment of a toy for a small child. As noted above, and further discussed below, the toy 10 encourages a small child to move toward the toy 10 by moving a distance and/or time and pausing, waiting or stopping for a period of time. If the toy does not sense an imparted motion during the period of time, the toy 10 returns a distance, preferably a shorter distance or for a time shorter than the initial length of time, in a sense toward its starting position, again pausing to entice the child to approach the toy 10. This process can repeat until, for example, the toy 10 shuts down due to continuing inaction by the child or due to interruption of power. As a further inducement to movement of the child toward the toy, the toy 10 can play music and/or make sounds while moving and/or pausing.

As illustrated by FIG. 1, the toy 10 is preferably in the shape of a ball. The toy 10 includes a substantially spherical or ball-shaped casing 12 enclosing components of the toy 10. The casing serves as a surface contacting member having an outer surface 14. Outer surface 14 defines a contact surface that is configured to contact and provide traction to traverse, for example, a floor, such as earth, carpet, tile, wood, asphalt, cement, and/or any other suitable generally flat or horizontal surface.

The casing 12 further has an interior surface 16 defining an interior volume of the toy 10. Housed within interior volume are components, which will be described in greater detail below. Preferably, casing 12 is formed of two, substantially equal half members (see FIG. 2). First half member 20 is configured to mate with second half member 22 using a snap or beaded connection 24. Such a connection allows for a flush exterior seam. Preferably, the connection between the half members 20, 22, is releasable to allow access to the interior, by, for example, an adult, while resisting access to the small child. To this end, the toy 10 can include a release mechanism that reduces the probability that a child might gain access to the interior volume. As an alternative to mating half members, the casing 12 may be provided with an access door, preferably connected to the casing by a hinge. Any one of a number of suitable releasable connections can be employed to releasably connect half members 20 and 22, including, e.g. snaps, detents, buckles, straps, etc. The connection between half members 20, 22 can also be semi-permanent or permanent using adhesives, welding techniques, fasteners and/or the like.

Figure 2:
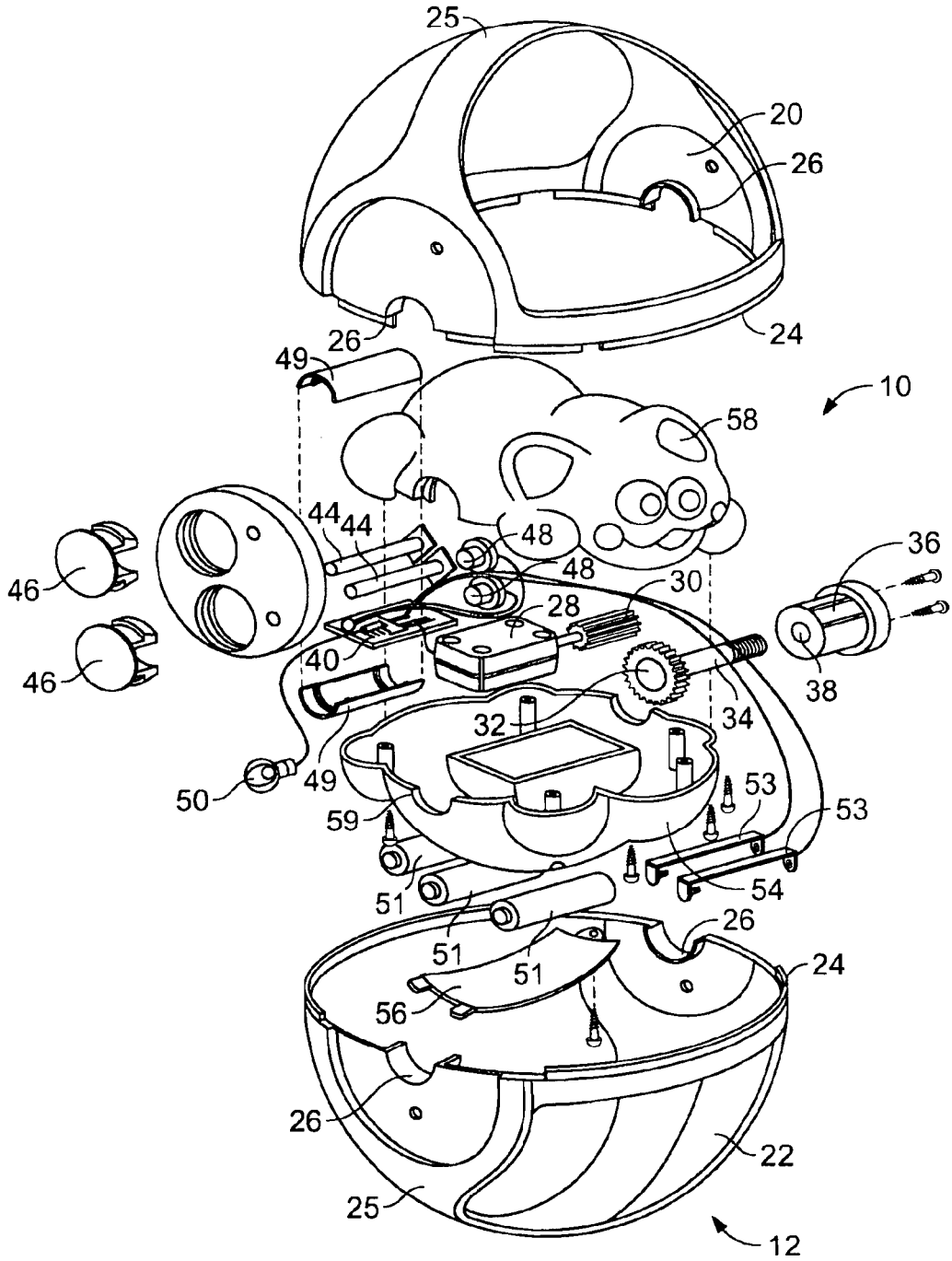
FIG. 2 is an exploded view of the toy of FIG. 1.

As shown in FIGS. 1 and 2, the outer surface 14 of the ball-shaped casing 12 includes ribs 25. Ribs 25 extend outwardly from the outer surface and provide additional traction to maneuver the toy 10 across surfaces. Ribs 25 also provide additional structural support to reduce the possibility of collapse or fracture of the casing 12, while permitting a relatively thinner wall thickness along non-ribbed areas of the casing 12. Ribs 25 can also extend inwardly from the inner surface.

Referring particularly to FIG. 2, each of the first and second half members 20, 22 of casing 12 includes a pair of recesses 26. Recesses 26 cooperate to form an opening for insertion of, for example, a drive element and/or to provide an aperture for allowing access to components positioned on the outer surface 14 of the casing 12.

Preferably, the casing 12 is at least partly formed of a transparent material to allow for viewing into the interior volume and the components therein. Suitable materials include, for example, thermoplastics and thermoset plastics. Due to increased wall thickness at rib locations, these locations may or may not be transparent. Preferably, ribs 25 are in a contrasting color to provide for a decorative design on the outer surface 14 while also providing support and traction. Casing 12 is preferably formed by injection molding, but may be formed by any other suitable process, such as compression molding, blow molding and vacuum forming.

FIG. 2 provides a relatively detailed exploded view of toy 10. As can be seen, components are housed within the internal volume of the casing 12. Casing 12 is operatively connected to a bi-directional motor 28, such as, e.g., a miniature DC motor, by a pair of cooperating gears 30 and 32, a gear pin 34 and pin housing 36. The pin housing 36 is coupled to the casing 12 within a pair of the recesses 26. A distal portion of gear pin 34 is securedly positioned within a cavity 38 of pin housing 36 so that torque is transferred from the gear pin 34 to the casing 12. Gears 30 and 32 serve to transfer torque from a drive shaft of the bi-directional motor 28 to the gear pin 34.

A control circuit or controller 40 is electrically connected to the motor 28 and generally governs operation of the motor 28. The controller 40 also controls the bi-directional motor's operating direction. A user interface 42 provides external interaction with controller 40 of the toy 10. The user interface 42 is in the form of on and off buttons 46 that are accessible from exterior of the casing 12. On and off pins 44 contact on and off buttons 46 by projecting through second pair of recesses 26 from the internal volume of casing 12. The on and off pins 44 extend through an axle housing 49 that is positioned within the second pair of recesses 26. Similar to pin housing 36, axle housing 49 is securedly coupled to the casing 12. Depressing on and off buttons 46 displaces its respective pin 44, which in turn, contacts respective on/off switches 48. Switches 48 can be configured to simply turn toy "on" or "off" and/or the switches 48 or only one switch 48 can be configured to toggle the toy between more than one mode, such as a GO mode and a PLAY-IN-BOX mode, and/or also on and off modes.

Also connected to controller 40 is speaker 50. Output of speaker 50 is also controlled by controller 40. Speaker 50 is adapted to output various sounds and/or music stored within a memory component of controller 40. Selection of the various stored music and/or sounds depends, at least in part, on modes of the device and/or interactions of the child, which will be described in more detail hereinafter.

The electrical components, such as the motor, speaker and controller, are powered by a power source 51. As illustrated, power source 51 consists of DC batteries, such as AA batteries. The batteries are positioned within sockets 53, providing an electrical connection with the various electrical components of the toy 10.

Referring now to FIGS. 1 and 2, toy 10 includes an internal casing 52. Internal casing 52 houses most of the internal components of toy 10, including the bi-directional motor 28 and power source 51. The internal casing 52 is pivotally supported within casing 12 by the pin housing 36 and axle housing 49, forming an axis of rotation of the toy 10. As can be seen in FIG. 2, the power source 51 along with sockets 53 are placed within a lower portion 54 of the internal casing 52 and secured by hatch 56. The motor 28, along with other components are positioned between the lower portion 54 and an upper portion 58 of the internal casing 52. Preferably, the upper and lower portions 54, 58 of internal casing 52 are securedly connected by, for example, adhesive, welding and/or fasteners, such as beaded connections, detents, snaps, etc. Hatch 56 can be removable to provide access to the power source 10, when necessary.

The position of the power source 51 within internal casing 52 provides an eccentric weight that serves to affect the angular orientation of internal casing 52 about the axis of rotation. For example, internal casing 51, as depicted, is in the form of a character that a small child may find entertaining or soothing. By positioning the eccentric weight within the internal housing as shown, the character can be maintained in a relatively horizontal position as the toy 10 rolls along the ground. Use of the eccentric weight also serves to dampen movement of the internal casing 52 as the toy 10 rolls, which may prolong the life of the internal components positioned therein. In some cases, additional weight may be desired. In these cases, the motor 28 can also be displaced with respect to the axis of rotation within internal casing 52. Alternatively, the weight of motor 28 can be positioned within internal casing 52 to have minimal effect on internal casing's angular orientation.

As noted above, many of the internal components are housed within internal casing 52. Thus, the internal casing 52 is provided with recesses 59 that cooperate to form openings. The openings allow for components such as the on and off pins 44 and gear pin 34 to extend out from an internal volume of the inner casing 52.

Internal casing 52 is preferably a two-piece design and each member can be formed of any suitable material including plastics such as thermoplastics and thermoset plastics. Preferably, internal casing 52 is formed in the shape of a character such as an animal, like a gerbil, for example. The position and arrangement of the character within the toy 10 and the design of the outer casing 12 provides a visual effect such as the gerbil running within the toy 10. The internal casing 52 can be formed using any suitable technique such as injection molding, compression molding, blow molding and vacuum forming.

Figure 3:
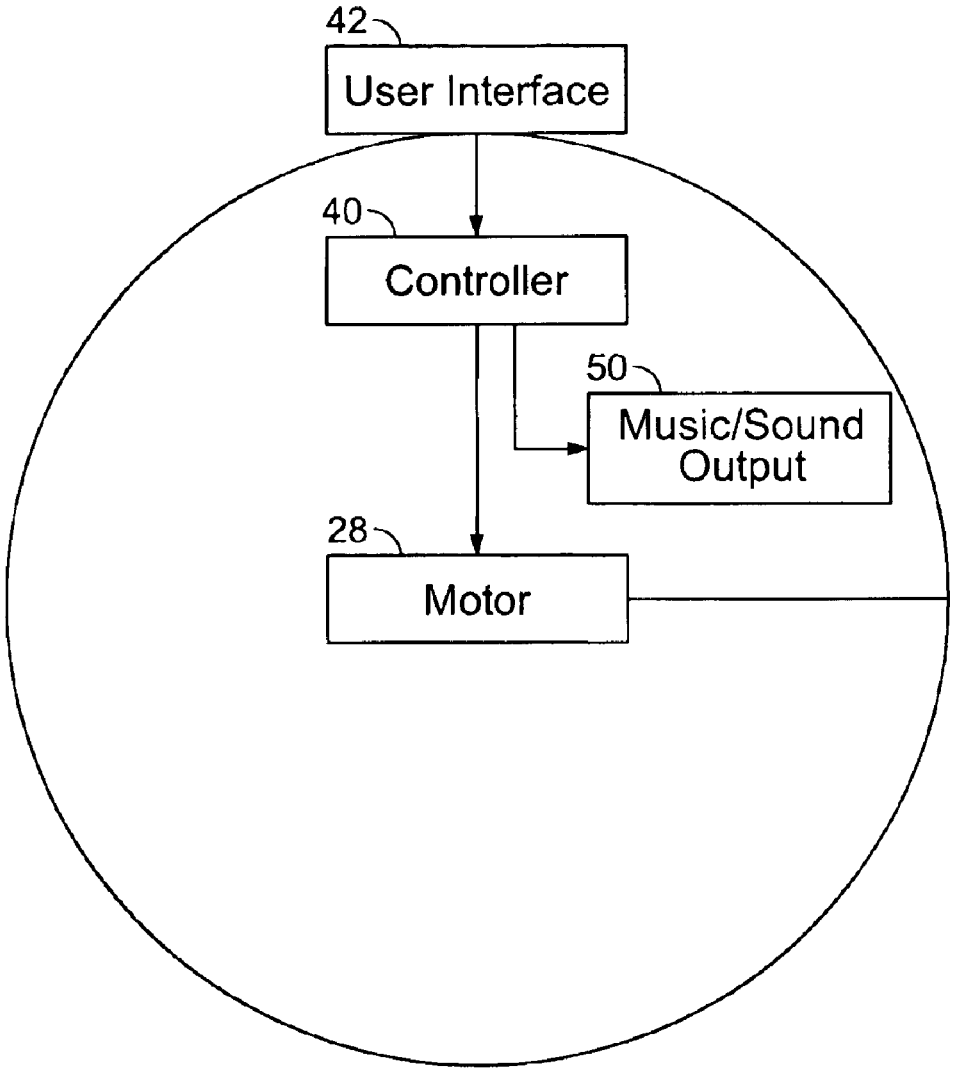
FIG. 3 is a schematic view of the toy of FIGS. 1 and 2.

FIG. 3 shows a simplified, schematic view of the operative components of toy 10. The user interface 42 allows a user to control modes of the toy 10. Depending on the user's mode selection, the controller 40 communicates with the motor 28 and music/sound output device, such as the speaker 50.

In operation, the motor 28 is bi-directional and is capable of providing a rotational output in a forward direction and a backward direction. The controller 40 dictates the direction and duration of rotation. Preferably, a jiggle switch that senses motion of the toy 10 sends a signal to the controller, which in turn, signals the motor for forward actuation. Suitable jiggle switches include a liquid mercury switch, a spring switch and a floating part switch, as examples. This forward actuation moves toy 10 in a forward direction. The jiggle switch can be activated by the user interface 42 and/or by an induced motion of the toy 10. It should be noted that while a jiggle switch is described, any suitable sensor capable of sensing motion of the toy and signaling the controller 40 can be used.

Once activated, the jiggle switch remains closed for a predetermined time, preferably between less than about 1 second to more than about 10 seconds, such as 4 seconds, for example. Opening or deactivation of jiggle switch can be controlled by a timing device, such as a timing circuit or a processor, and/or the jiggle switch can, itself, be a momentary switch configured to delay deactivation upon activation for a predetermined length of time. The period of time that the jiggle switch remains closed can be a particular period of time or the period of time can vary. This variation can be random, for example, within a predetermined range of time, or the variation can be predetermined. Importantly, because the toy 10 moves forward from an initial location when the jiggle switch is activated, the length of time should correspond to a distance that entices the child to approach toy 10. A preferable range of distances is from about 1 ft. to about 10 ft. or 4 ft., as an example. Knowing the motor speed, gear ratio, dimensions of the casing 12, and the distance, the period of time can be easily calculated. It should be noted, however, that actual travel distance of toy 10 for a calculated actuation time may differ from the desired distance. This is due to many factors including friction, obstacles, etc.

Opening of the jiggle switch halts forward rotation of motor 28. Until the jiggle switch is reactivated or until the controller 40 signals reverse rotation, the toy 10 is no longer propelled by motor 28.

The controller 40 signals reverse rotation when, for a period of time, the jiggle switch or sensor detects no imparted motion of the toy 10. The controller 40, using a timer and/or processor, as examples, monitors whether a signal has been received. If the signal is received during the period of time, the motor 28 is actuated in the forward direction as described above. If no signal is received, the motor 28 is actuated in a reverse direction to move the toy in a sense back toward the starting location (see FIG. 5).

Tables I and II are examples of electronics sequences that can be used with toy 10.

TABLE I

| (GO Switch/Mode) |
|---|
| Sequence A |
| Run motor forward for 3 sec (about 21–24 in) and play ROLLING SONG MUSIC for duration of motor run (always play music when motor is on)<br>Play SOUND LIST B (sequence sounds with each activation)<br>Look for jiggle switch activation for 4 seconds<br>If no jiggle switch activation is seen, play Sequence C<br>If jiggle switch activated, play Sequence A |
| Sequence B |
| Play SOUND LIST A and reverse motor for 1 sec (about 7–8 in) (sequence sounds with each activation)<br>Look for jiggle switch activation for 4 sec<br>If no jiggle switch activation is seen, play Sequence C<br>If jiggle switch activated, play Sequence A |
| Sequence C |
| Play SOUND LIST A and reverse motor for 1 sec (about 7–8 in) (sequence sounds with each activation)<br>Look for jiggle switch activation for 4 sec<br>If no jiggle switch activation is seen, shut off<br>If jiggle switch is activated, play Sequence A |

Preferably, SOUND LIST B includes sounds that tend to entice a child to follow such as, "LetsPlay" and "Follow Me." SOUND LIST A preferably includes sounds that tend to entice a child to approach the toy 10, such as "TFY Giggle." The sound lists can also include sounds that correlate with the action being performed by the toy. For example, as the toy 10 stops rolling in reverse, toy 10 sounds "Whoa."

TABLE II

| (GO Switch/Mode) |
|---|
| Sequence A |
| When switch is pressed one time the motor is activated<br>Run motor forward for 5 sec (about 35–40 in) and play SONG LIST A for duration of song<br>Play SOUND LIST B after 5 sec<br>Wait 1.5 sec for ball to settle (do not respond to jiggle switch)<br>Activate jiggle switch<br>Play SOUND LIST C<br>Wait 2 sec and look for jiggle switch activation<br>If jiggle switch is activated, restart Sequence A<br>If no jiggle switch activation is seen after 2 sec, immediately play Sequence B |
| Sequence B |
| Play SOUND LIST A<br>Run motor reverse for 5 sec (about 35–40 in) and play SONG LIST B for duration of song<br>Play SOUND LIST B after 5 sec<br>Wait 1.5 sec for ball to settle (do not respond to jiggle switch)<br>Activate jiggle switch<br>Play SOUND LIST C<br>Wait 2 sec, look for jiggle switch activation<br>If jiggle switch is activated, play Sequence A<br>If no jiggle switch activation is seen, activate SHUT-DOWN MODE |
| SHUT-DOWN MODE |
| Stay silent but monitor jiggle switch for 10 minutes<br>If jiggle switch is activated, go to Sequence A<br>If no jiggle switch activation, shut off |

As above with regard to the sequences of Table I, the song lists and sound lists can be tailored to correspond with actions of the toy.

Figure 4:
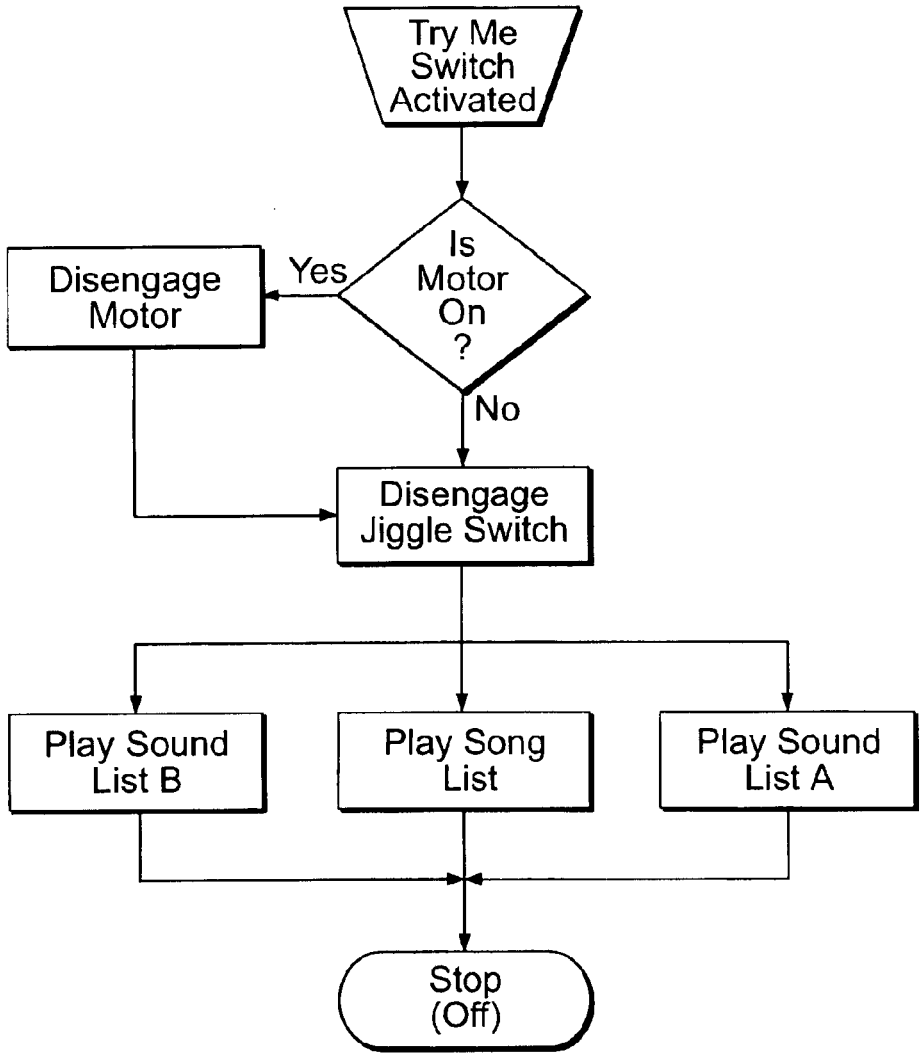
FIG. 4 is a schematic diagram of an electronics sequence of the toy of FIGS. 1 and 2 in PLAY-IN-BOX mode.

Toy 10 can also include a PLAY-IN-BOX mode, an example of which is schematically represented by FIG. 4. Similar to the GO mode, the PLAY-IN-BOX mode is selected using the user interface 42. Selecting PLAY-IN-BOX mode disengages the jiggle switch and/or motor, if active, and signals the controller to play music and sounds only. The music and sounds played in PLAY-IN-BOX mode can be the same as or different from the sounds and music played in GO mode and can be played in a predetermined and/or a random sequence. PLAY-IN-BOX mode can also include activation of the jiggle switch and/or motor.

Figure 5:
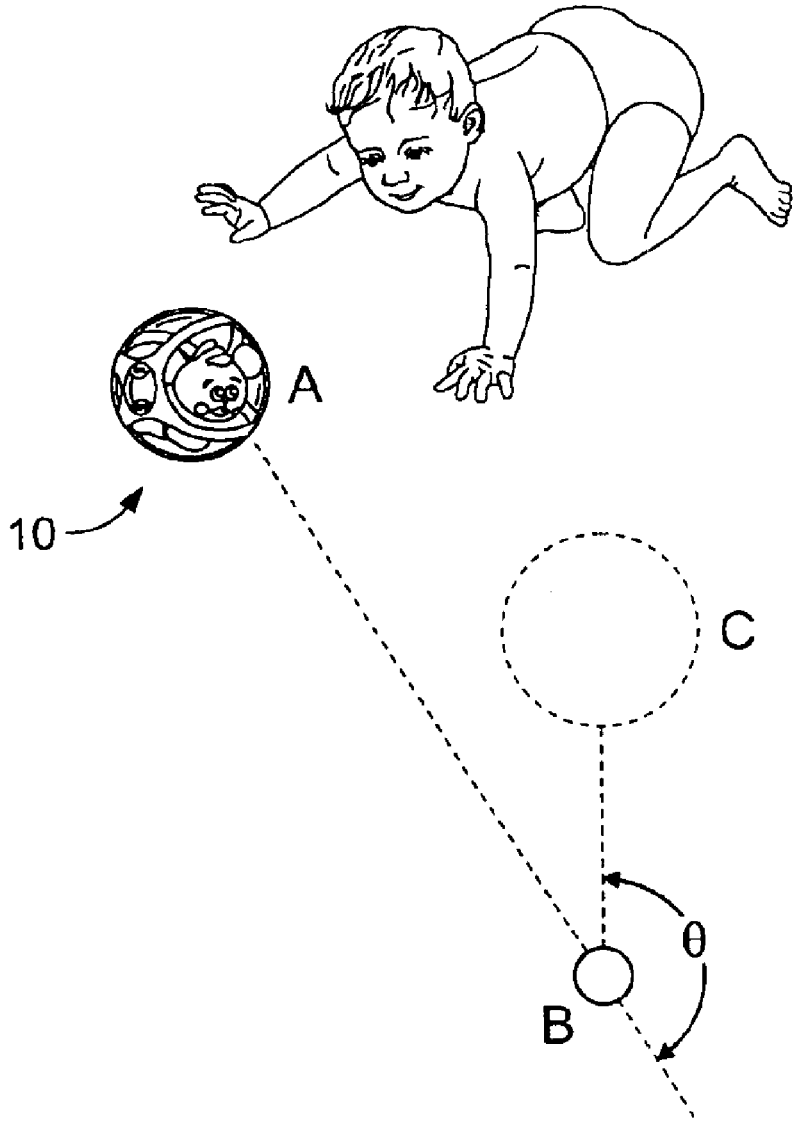
FIG. 5 is an illustration of the toy of FIGS. 1 and 2 in use.

Referring to FIG. 5, an illustration of toy 10 in use is shown. Initially, toy 10, in GO mode, is at rest in an initial location A. A child bats, swipes or otherwise impacts toy 10 to impart a motion of the toy 10. The sensor or jiggle switch detects or senses the motion and sends a signal to the controller. The controller, in response to the signal activates the bi-directional motor to move the toy 10 in a forward or encouraging direction. The toy 10 moves for a length of time, such as 3 seconds, and then comes to rest (i.e., the controller disengages the motor) at position B. While at rest at position B, if the child does not impart a second motion of the toy 10 within 4 seconds, the controller activates the motor to move the toy 10 in a sense back toward the initial location, coming to rest at position C. This provides further encouragement for the child to approach the toy 10 by reducing the distance between the child and toy 10.

As illustrated, the toy 10 returns at an angle θ to the initial direction. Preferably, the toy 10 returns at an angle between about 90 to about 270 degrees, such as about 180 degrees, as an example. Additionally, the toy, as shown, returns a fraction of the initial distance traveled. In some cases, the toy 10 is configured to return a substantially equivalent distance back toward the initial position.

A number of embodiments of the invention have been described. Nevertheless, it will be understood that various modifications may be made without departing from the spirit and scope of the invention. For example, some embodiments include a body and the contacting member can rotate with respect to the body. In some of these cases, the contacting member is in the form of a wheel and most of the components are housed within the body (e.g., the toy is formed as an automobile, or tracked vehicle). Additionally, the toy can include a light, such as an LED to, for example, signal the mode of operation of the toy or to further catch and retain the attention of the small child. In some embodiments, the outer surface of the casing includes grooves that provide traction. In some cases, the casing 12 can include opposing recesses extending into the interior of the casing to allow for support within a storage container, such as a box. The toy may be rotationally supported within the box to allow the toy to rotate when PLAY-IN-BOX mode is activated. Accordingly, other embodiments are within the scope of the following claims.

What is claimed is:

1. A developmental toy for small children, the toy comprising a contacting member;

an electric motor that rotates the contacting member to move the toy along a surface;

a sensor responsive to input from a child; and a controller that, in response to indication from the sensor of receipt of the input, signals the electric motor to move the toy from a starting position for an initial period of time in an initial direction, signals the motor to wait a waiting period of time, and if no further input is received within the waiting period of time, signals the motor to move the toy in an opposite sense, generally toward the starting location, at an angle between about 90 degrees to about 270 degrees relative to the initial direction.

2. The developmental toy of claim 1, wherein the controller signals the motor to move the toy for a second period of time less than 100 percent of the initial period of time in the opposite sense.

3. The developmental toy of claim 2, wherein the toy moves a second period of time from about one-quarter to about three-quarters of the initial period of time in the opposite sense.

4. The developmental toy of claim 3, wherein the toy moves a second period of time about one-third of the initial time in the opposite sense.

5. The developmental toy of claim 1, wherein the controller signals the motor to move the toy for a second period of time about the initial period of time in the opposite sense.

6. The developmental toy of claim 1, wherein the contacting member defines an arcuate contacting surface configured to roll along a surface.

7. The developmental toy of claim 6, wherein the toy has a body and wherein the contacting member comprises a wheel that rotates with respect to the body.

8. The developmental toy of claim 7, further including an eccentric weight, the motor rotating the contacting member with respect to the eccentric weight.

9. The developmental toy of claim 6, wherein the toy is in the form of a ball, the contacting member defining an exterior surface of the ball.

10. The developmental toy of claim 1, wherein the input is an induced motion of the toy.

11. The developmental toy of claim 10, wherein the induced motion is a linear acceleration of the toy.

12. The developmental toy of claim 10, wherein the induced motion is a rotational acceleration of the toy.

13. The developmental toy of claim 1, wherein the input is audible.

14. The developmental toy of claim 1 further comprising a sound source for providing audible sound.

15. The developmental toy of claim 14, wherein the sound source provides audible sound only while moving.

16. The developmental toy of claim 14, wherein the sound source provides audible sound only while waiting.

17. The developmental toy of claim 14, wherein the sound source provides audible sound while moving and waiting.

18. The toy of claim 1, wherein the toy moves in the opposite sense at an angle of about 180 degrees relative to the initial direction.

19. A method for developing motor skills of a small child using a toy, the method comprising:

providing control circuitry for controlling actuation of a motor, the motor configured to rotate a drive shaft in a first direction and in an opposite, second direction;

operatively connecting the drive shaft to a contacting member to cause rotation of the contacting member, the contacting member configured to move the toy a distance;

signaling the control circuitry to actuate the motor to rotate the drive shaft in the first direction for moving the toy in an initial direction for an initial period of time along a surface in response to a first induced motion of the toy;

signaling the control circuitry to discontinue actuation of the motor for a waiting period of time; and in the absence of a second induced motion for the waiting period of time, signaling the control circuitry to actuate the motor in the second direction for moving the toy in a sense generally opposite and at an angle between about 90 degrees to about 270 degrees relative to the initial direction.

20. A developmental toy for small children comprising:

a contacting member configured to move the toy;

a bi-directional motor including a drive shaft operatively connected to the contacting member, the bi-directional motor configured to rotate the drive shaft in a first direction and in a second, opposite direction; and control means for actuating the bi-directional motor to rotate the contacting member and move the toy along a surface a distance in an initial direction and for pausing the bi-directional motor to maintain a position of the toy;

wherein, in response to a first induced motion, the control means actuates the bi-directional motor in the first direction for a first period of time and pauses the bi-directional motor after the first period of time for a resting period of time; and wherein, in the absence of a second induced motion during the resting period of time, the control means actuates the bi-directional motor in the second direction at an angle between about 90 degrees to about 270 degrees relative to the initial direction for a second period of time.

21. The developmental toy of claim 20, wherein the second period of time is about equivalent to the first period of time.

22. The development toy of claim 20, wherein the second of time is different from the first period of time.

23. The developmental toy of claim 20 further including sensor means for sensing induced motion of the toy and providing a signal to the control means in response to induced motion.

24. A method for developing the motor skills of a child using a developmental toy having a contacting member, an electric motor that rotates the contacting member to move the toy along a surface, a sensor responsive to input from a child and a controller that, in response to indication from the sensor of receipt of the input, signals the electric motor to move the toy in an initial direction, the method comprising:

in response to indication from the sensor, moving the toy from an initial position for a first period of time;

pausing the toy for a resting period of time; and if no signal received from the sensor within the resting period of time, moving the toy in an opposite sense, generally toward the starting location at an angle between about 90 degrees to about 270 degrees relative to the initial direction.

* * * * *